US005310114A

United States Patent [19]

Cann

[11] Patent Number: 5,310,114

[45] Date of Patent: May 10, 1994

[54] APPARATUS AND METHOD FOR MEASURING PAINT USAGE IN A PAINTING SYSTEM

[76] Inventor: Roger S. Cann, 28670 Old River Rd., Mt. Clemens, Mich. 48045

[21] Appl. No.: 945,525

[22] Filed: Sep. 16, 1992

[51] Int. Cl.[5] ..... B05B 9/00

[52] U.S. Cl. ..... 239/74; 239/124

[58] Field of Search ..... 239/1, 11, 67-69, 239/71, 74, 124, 125, 127; 73/196, 195

[56] References Cited

U.S. PATENT DOCUMENTS

| | | | |
|---|---|---|---|
| 3,524,587 | 8/1970 | Pescatore | 239/127 |
| 3,711,689 | 1/1973 | Park | 73/196 |
| 3,720,373 | 3/1973 | Levey | 239/127 |
| 3,723,987 | 3/1973 | Barone, Jr. et al. | 73/196 |
| 4,106,699 | 8/1978 | Holt | 239/127 |
| 4,118,780 | 10/1978 | Hirano | 73/196 |
| 4,405,086 | 9/1983 | Vetter | 239/224 |
| 4,562,088 | 12/1985 | Navarro | 427/8 |
| 4,894,252 | 1/1990 | Bongen et al. | 427/8 |
| 4,972,180 | 11/1990 | Akai et al. | 340/611 |
| 4,992,952 | 2/1991 | Sasaki | 364/510 |
| 5,102,045 | 4/1992 | Diana | 239/68 |

*Primary Examiner*—Karen B. Merritt

*Attorney, Agent, or Firm*—Reising, Ethington, Barnard, Perry & Milton

[57] ABSTRACT

An apparatus and method for measuring paint usage in a painting system of the type having a reservoir (12) connected to an atomizer (14) by a supply line (16) and return line (18). A feed flowmeter (24) is disposed in the atomizer feed line (16) and a return flowmeter (26) is disposed in the atomizer return line (18) for measuring the respective volumes of paint flow through the atomizer feed line (16) and return line (18). A processor (28) provides the difference between the volume of paint flow through the atomizer feed and return lines (16,18) as measured by the feed and return flowmeters (24,26), respectively, to determine the volume of paint discharged through the atomizer (14).

13 Claims, 2 Drawing Sheets

APPARATUS AND METHOD FOR MEASURING PAINT USAGE IN A PAINTING SYSTEM

TECHNICAL FIELD

The subject invention relates to an apparatus and method for measuring paint usage in a painting system.

BACKGROUND OF THE INVENTION

Present paint systems are only capable of measuring average paint use over a considerable amount of time. Most of these systems employ the method of averaging paint quantities purchased over time to determine paint usage. However, this averaging method of measuring paint usage does not account for actual usage, i.e., paint discharged through the atomizer of the painting system for application to an object. Instead, this averaging method provides paint use data which includes not only paint discharged through the atomizer of a painting system, but also paint lost from the system due to leaks in the supply or return lines and/or spilling. Thus, there is no accurate apparatus and/or method for measuring the volume of paint flow actually discharged through the atomizer of a painting system.

The prior art known to the applicant teaches various techniques used to indicate paint clogging, control the flow rate of paint discharged, measure the rate of paint discharged, or to maintain a constant flow rate of paint discharged in a painting system. This prior art is represented by U.S. Pat. Nos. 4,894,252; 4,972,180; 4,562,088; and 4,992,952.

SUMMARY OF THE INVENTION AND ADVANTAGES

The apparatus of the present invention comprises a reservoir for holding a supply of paint and an atomizer for discharging paint toward an object to be painted. An atomizer feed line extends between the reservoir and the atomizer for supplying paint from the reservoir to the atomizer and an atomizer return line extends between the atomizer and the reservoir for returning a portion of the paint supplied to the atomizer back to the reservoir. The apparatus of the present invention is characterized by a feed flowmeter positioned in the atomizer feed line for measuring the volume of paint flow through the atomizer feed line and a return flowmeter positioned in the atomizer return line for measuring the volume of paint flow through the atomizer return line. A processor provides the difference between the volume of paint flow through the atomizer feed line as measured by the feed flowmeter and the volume of paint flow through the atomizer return line as measured by the return flowmeter to determine the volume of paint flow discharged through the atomizer.

The method of the present invention includes the steps of measuring the volume of paint flow through the atomizer feed line, measuring the volume of paint flow through the atomizer return line, and determining the difference between these two volumes to determine the volume of paint flow discharged through the atomizer.

The main advantage of the present invention over the prior art is the accurate measurement of paint discharged by a painting system. With the present invention, paint and solvent usage data can be accurately reported to governmental agencies as required by environmental legislation. The present invention also allows a user to control and monitor paint usage to provide an even and uniform coating of paint on the object to be painted preventing waste and thereby saving material and cost.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
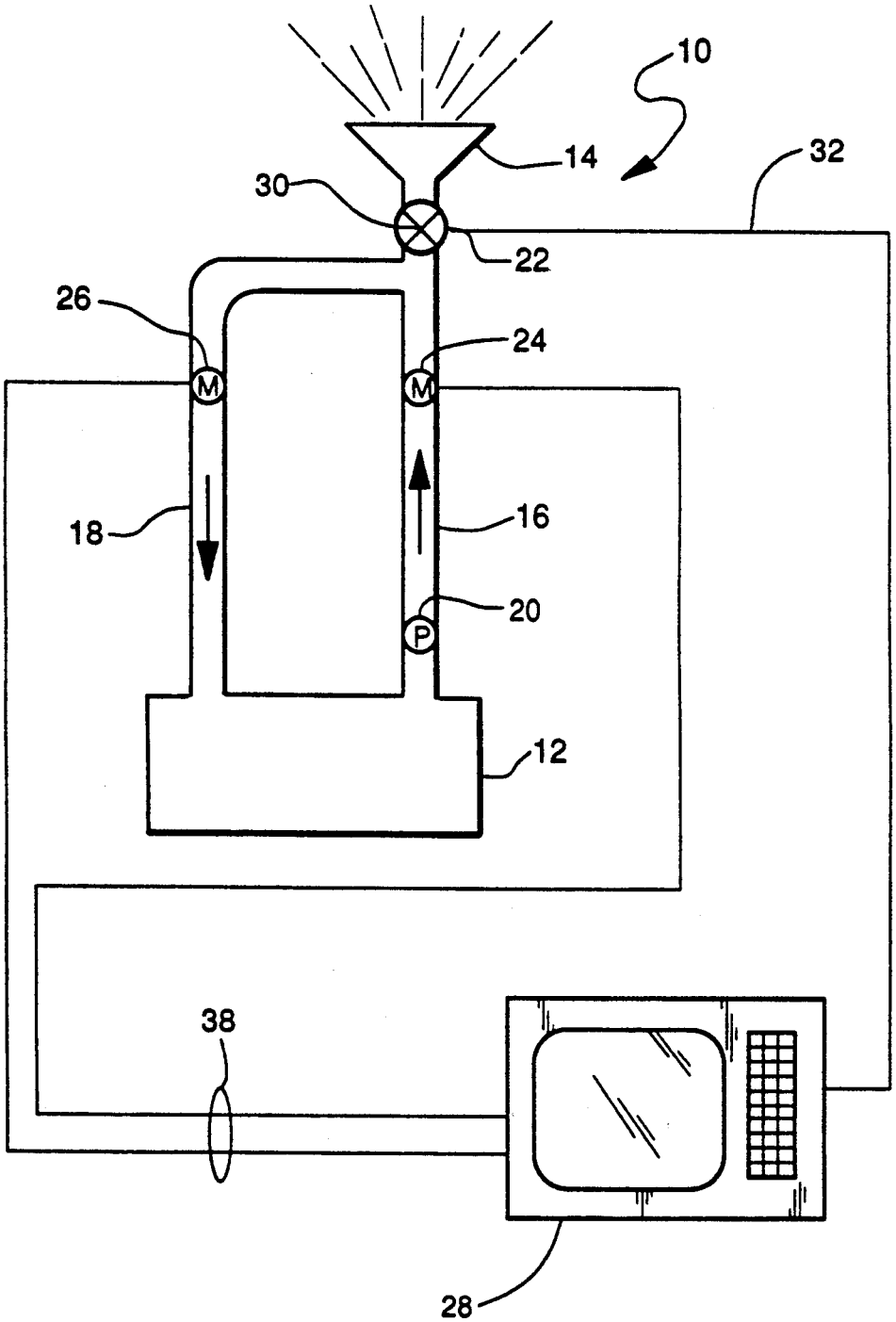
FIG. 1 is a schematic drawing of a painting system with a single atomizer embodying the concepts of the invention.

Referring to FIG. 1, an apparatus for measuring paint usage in a painting system 10 is provided. The apparatus comprises a reservoir or holding tank 12 for holding a supply of paint or other viscous material and an atomizer 14 for discharging paint toward an object to be painted, such as an automobile. It will be appreciated that the atomizer 14 can be any type Of standard atomizer such as the one described in U.S. Pat. No. 4,405,086. The atomizer 14 can be of the type hand held and operated by a user or of the type permanently fixed in the painting system 10 and controlled by a processor 28 and feedback loop 32 as described below.

An atomizer feed line or conduit 16 extends between the reservoir 12 and the atomizer 14 for supplying paint from the reservoir 12 to the atomizer 14 and an atomizer return line or conduit 18 extends between the atomizer 14 and the reservoir 12 for returning a portion of the paint supplied to the atomizer 14 back to the reservoir 12. The volumetric capacities of atomizer feed line 16 and atomizer return line 18 are set to predetermined values so that paint flows continously through each line 16, 18.

A valve 22, such as described in U.S. Pat No. 4,405,086, is disposed in the atomizer 14 for preventing paint flow through the atomizer 14. The valve 22 can be in either an "open" or "closed" position. When the valve 22 is in the open position, paint is discharged through the atomizer 14. When the valve 22 is in the closed position, paint cannot be discharged through the atomizer 14. Regardless of whether the valve 22 is in the open or closed position, a pump 20 disposed in the atomizer feed line 16 continuously moves, pumps or circulates the paint at a predetermined rate from the reservoir 12, through the atomizer feed line 16, to the atomizer 14, through the atomizer return line 18, and back to the reservoir 12. In this manner, particles in the paint, such as metallic particles and pigments, remain in suspension and are prevented from settling. Also, continuous circulation of the paint prevents it from drying and causing clogging in the painting system 10. The valve 22 comprises a variable orifice 3, such as a Ransburg Fluid Regulator model DR-1, for varying the volume of paint flow through the atomizer 14.

The apparatus of the invention further includes a feed flowmeter 24 disposed in the atomizer feed line 16 for measuring the volume of paint flow through the atomizer feed line 16 and a return flowmeter 26 disposed in the atomizer return line 18 for measuring the volume of paint flow through the atomizer return line 18. Feed flowmeter 24 and return flowmeter 26 could be of the type used for measuring the volume of fuel used by an aircraft, such as a Shadin flowmeter, which provides instant flow in gallons per hour, accumulated gallons used, etc.

A processor 28, such as a Motorola 68000, calculates and provides the difference between the volume of paint flow through the atomizer feed line 16, as determined by the feed flowmeter 24, and the volume of paint flow through the atomizer return line 18, as determined by the return flowmeter 26, to determine the volume of paint flow discharged through the atomizer 14. In other words, the processor 28 calculates the volume or portion of paint not returned to the reservoir 12 via the atomizer return line 18, i.e. the volume of paint discharged through the atomizer 14, by providing the difference between the volume of paint flow to the atomizer 14 via the atomizer feed line 16 and the volume of paint flow from the atomizer 14 via the atomizer return line 18. The processor 28 receives the volume of paint flow data from feed flowmeter 24 and return flowmeter 26 via electrical paths 38. The paint usage data determined by the processor 28 can be displayed on an output device such as a video monitor or printer. The processor 28 can be used in a painting system 10 with either the hand held type or processor controlled/feedback loop type atomizer 14 as described above.

If the atomizer 14 is not the hand held type, a feedback loop 32 is provided which extends from the variable orifice 30 to the processor 28 for controlling the variable orifice 30 to maintain a predetermined volume of paint flow through the atomizer 14. The feedback loop 32 uses the calculated volume of paint flow discharged from the atomizer 14 as determined by the processor 28 and compares this value with a desired predetermined volume of paint flow. If the two values are not equal, the processor 28 instructs the variable orifice 30 to either contract, making the orifice 30 smaller in diameter, or expand, making the orifice 30 larger in diameter, until the volume of paint flow discharged from the atomizer 14 equals the desired predetermined volume of paint flow.

According to the present invention, a method for measuring the volume of paint discharged through the atomizer 14 is provided. The method includes the steps of measuring the volume of paint flow through the atomizer feed line 16, measuring the volume of paint flow through the atomizer return line 18, and determining the difference between these two measurements to determine the volume of paint flow discharged through the atomizer 14. The method is further characterized by continuously circulating the paint from the reservoir 12, through the atomizer feed line 16, to the atomizer 14, through the atomizer return line 18, and back to the reservoir 12 independent of the volume of paint flow discharged through the atomizer 14. The method is further characterized by supplying a predetermined volume of paint flow to the atomizer 14 via atomizer feed line 16 greater than the volume of paint flow discharged through the atomizer 14. It will be appreciated that the aforementioned method can be used in a painting system which utilizes a plurality of atomizers 14.

Figure 2:
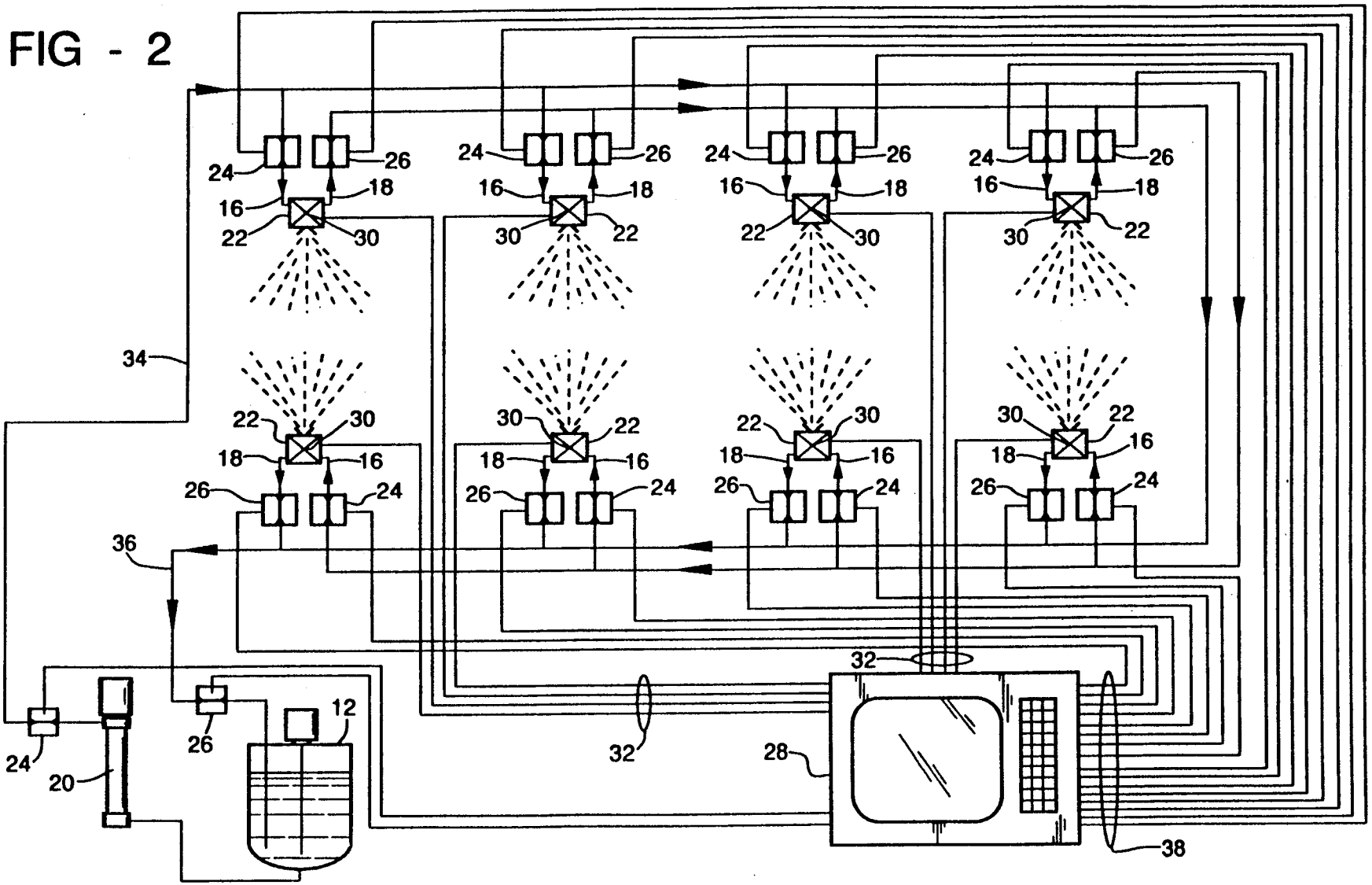
FIG. 2 is a schematic drawing of a painting system with a plurality of atomizers embodying the concepts of the invention.

According to the invention, a painting system 10 comprising a plurality of atomizers 14 is shown in FIG. 2. A system supply line or conduit 34 extends from reservoir 12 and links with each atomizer feed line 16 for supplying paint from reservoir 12 to each atomizer 14. A system reservoir line or conduit 36 extends to the reservoir 2 and links with each atomizer return line 18 for returning paint from each atomizer 14 back to the reservoir 12. The volumetric capacities of atomizer feed lines 16, atomizer return lines 18, system supply line 34, and system reservoir line 36 are set to predetermined values so that paint flows continously through each line 16, 18, 34, and 36. A valve 22 is disposed in each atomizer 14 for terminating the flow of paint in each atomizer 14. Each valve comprises a Variable orifice 3 for varying the volume of paint flow through each atomizer 14. Regardless of Whether each valve 22 is in the open or closed position, as defined in the aforementioned description of a single atomizer painting system, a pump 20 disposed in the system supply line 34 continuously moves, pumps or circulates the paint at a predetermined rate from the reservoir 12, through the system supply line 34, through each atomizer feed line 16, to each atomizer 14, through each atomizer return line 18, through the system reservoir line 36, and back to the reservoir 12. In this manner, particles in the paint, such as metallic particles and pigments, remain in suspension and are prevented from settling. Also, continuous circulation of the paint prevents it from drying and causing clogging in the painting system 10.

The apparatus of the invention further includes a feed flowmeter 24 disposed in each atomizer feed line 16 for measuring the volume of paint flow through each atomizer feed line 16 and a return flowmeter 26 disposed in each atomizer return line 18 for measuring the volume of paint flow through each atomizer return line 18. Processor 28 calculates and provides the difference between the volume of paint flow through each atomizer feed line 16, as determined by each feed flowmeter 24, and the volume of paint flow through each corresponding atomizer return line 18, as determined by return flowmeters 26, to determine the volume of paint flow discharged through each atomizer 14. A feed flowmeter 24 is disposed in the system supply line 34 upstream of all atomizer feed lines 16 for measuring the Volume of paint flow through the system supply line 34. A return flowmeter 26 is disposed in the system reservoir line 36 downstream of all atomizer return lines 8 for measuring the volume of paint flow through the system reservoir line 36. In this manner, the processor 28 can determine the total volume of paint discharged from the painting system 10. The processor 28 receives the volume of paint flow data from feed flowmeters 24 and return flowmeters 26 via electrical paths 38. The paint usage data determined by the processor 28 can be displayed on an output device such as a video monitor or printer.

As with the single atomizer painting system described above, feedback loops 32 extend from each variable orifice 30 to the processor 28 for controlling each variable orifice 30 to maintain a predetermined volume of paint flow through each atomizer 14. If an atomizer 14 is the hand held type, then a feedback loop 32 is not needed to control variable orifice 30 since it is controlled manually by the user.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus for measuring and controlling paint usage in a painting system (10), said apparatus comprising:

a reservoir (12) for holding a supply of paint;

an atomizer (14) for discharging paint toward an object to be painted;

an atomizer feed line (16) extending between said reservoir (12) and said atomizer (14) for supplying paint from said reservoir (12) to said atomizer (14);

an atomizer return line (18) extending between said atomizer (14) and said reservoir (12) for returning a portion of the paint supplied to said atomizer (14) back to said reservoir (12);

a feed flowmeter (24) positioned in said atomizer feed line (16) for measuring the volume of paint flow through said atomizer feed line (16), a return flowmeter (26) positioned in said atomizer return line (18) for measuring the volume of paint flow through said atomizer return line (18), and a processor (28) for providing the difference between the volume of paint flow through said atomizer feed line (16) as determined by said feed flowmeter (24) and the volume of paint flow through said atomizer return line (18) as determined by said return flowmeter (26) to determine the volume of paint flow discharged through said atomizer (14);

valve means (22) disposed in said atomizer (14) for terminating paint flow through said atomizer (14), said valve means (22) comprising a variable orifice (30) for varying the volume of paint flow through said atomizer (14); and characterized by a feedback loop (32) extending from said variable orifice (30) to said processor (28) for controlling said variable orifice (30) to maintain a predetermined volume of paint flow through said atomizer (14).

2. The apparatus of claim 1 further characterized by a pump means (20) positioned in said atomizer feed line (16) for moving paint from said reservoir (12), through said atomizer feed line (16), to said atomizer (14), through said atomizer return line (18), and back to said reservoir (12).

3. The apparatus of claim 1 wherein the volumetric capacities of said atomizer feed line (16) and said atomizer return line (18) are set to predetermined values so that paint flows continously through said lines (16), (18).

4. An apparatus for measuring and controlling paint usage in a painting system (10), said apparatus comprising:

a reservoir (12) for holding a supply of paint;

a plurality of atomizers (14) for discharging paint toward an object to be painted;

a system supply line (34) extending from said reservoir (12) for supplying paint from said reservoir (12) to each of said atomizers (14);

a system reservoir line (36) extending to said reservoir (12) for returning paint from said atomizers (14) back to said reservoir (12);

one atomizer feed line (16) per each of said atomizers (14) extending from said system supply line (34) to each said atomizer (14) for supplying paint from said system supply line (34) to each atomizer (14);

one atomizer return line (18) per each of said atomizers (14) extending from each said atomizer (14) to said system reservoir line (36) for returning paint from each atomizer (14) back to said system reservoir line (36);

a feed flowmeter (24) positioned in each of said atomizer feed lines (16) for measuring the volume of paint flow through each of said atomizer feed lines (16), a return flowmeter (26) positioned in each of said atomizer return lines (18) for measuring the volume of paint flow through each of said atomizer return lines (18), and a processor (28) for providing the difference between the volume of paint flow through each of said atomizer feed lines (16) as determined by each of said feed flowmeters (24) and the volume of paint flow through each of said atomizer return lines (18) as determined by each of said return flowmeters (26) to determine the volume of paint flow discharged through each of said atomizers (14);

valve means (22) disposed in each of said atomizers (14) for terminating paint flow through each of said atomizers (14) wherein each of said valve means (22) comprises a variable orifice (30) for varying the volume of paint flow through each of said atomizers (14); and characterized by one feedback loop (32) per each of said atomizers (14) extending from each of said variable orifices (30) to said processor (28) for controlling each of said variable orifices (30) to maintain a predetermined volume of paint flow through each of said atomizers (14).

5. The apparatus of claim 4 further characterized by including a feed flowmeter (24) in said system supply line (34) upstream of all said atomizer feed lines (16) TM and a return flowmeter (26) in said system reservoir line (36) downstream of all said atomizer return lines (18) for determining the total volume of paint flow discharged from the painting system (10).

6. The apparatus of claim 4 further characterized by a pump means (20) positioned in said system supply line (34) for moving paint from said reservoir (12), through said system supply line (34), through said atomizer feed lines (16), to said atomizers (14), through said atomizer return lines (18), through said system reservoir line (36), and back to said reservoir (12).

7. The apparatus of claim 4 wherein the volumetric capacities of each of said atomizer feed lines (16), each of said atomizer return lines (18), said system supply line (34), and said system reservoir line (36) are set to predetermined values so that paint flows continously through said lines (16), (18), (34), and (36).

8. A method for measuring and controlling paint usage in a painting system (10) of the type having a reservoir (12) for holding a supply of paint, an atomizer (14) for discharging paint toward an object to be painted, an atomizer feed line (16) extending between the reservoir (12) and the atomizer (14) for supplying paint from the reservoir (12) to the atomizer (14), and an atomizer return line (18) extending between the atomizer (14) and the reservoir (12) for returning a portion of the paint supplied to the atomizer (14) back to the reservoir (12); said method comprising the steps of:

measuring the volume of paint flow through the atomizer feed line (16);

measuring the volume of paint flow through the atomizer return line (18);

determining the difference between these two measurements to determine the volume of paint flow discharged through the atomizer (14);

comparing the volume of paint flow discharged from the atomizer (14) to a desired predetermined volume of paint flow; and controlling the volume of paint flow discharged from the atomizer (14) so that the volume of paint flow discharged from the atomizer (14) equals the desired predetermined volume of paint flow.

9. The method as set forth in claim 8 further characterized by continuously circulating paint from the reservoir (12), through the atomizer feed line (16), to the atomizer (14), through the atomizer return line (18), and back to the reservoir (12) independent of the volume of paint flow discharged through the atomizer (14).

10. The method as set forth in claim 8 further characterized by supplying a predetermined volume of paint flow to the atomizer (14) via the atomizer feed line (16) greater than the volume of paint flow discharged through the atomizer (14).

11. A method for measuring and controlling paint usage in a painting system (10) of the type having a reservoir (12) for holding a supply of paint, a plurality of atomizers (14) for discharging paint toward an object to be painted, a system supply line (34) extending from the reservoir (12) for supplying paint from the reservoir (12) to each atomizer (14), a system reservoir line (36) extending to the reservoir (12) for returning a portion of the paint supplied to each atomizer (14) back to the reservoir (12), one atomizer feed line (16) per each atomizer (14) for supplying paint from the system supply line (34) to each atomizer (14), one atomizer return line (18) per each atomizer (14) for returning a portion of the paint supplied to each atomizer (14) to the system reservoir line (36); said method comprising the steps of:

measuring the volume of paint flow through each atomizer feed line (16);

measuring the volume of paint flow through each atomizer return line (18);

determining the difference between these two measurements to determine the volume of paint flow discharged through each atomizer (14);

comparing the volume of paint flow discharged from each atomizer (14) to a desired predetermined volume of paint flow for each atomizer (14), and controlling the volume of paint flow discharged from each atomizer (14) so that the volume of paint flow discharged from each atomizer (14) equals the desired predetermined volume of paint flow for each atomizer (14).

12. The method as set forth in claim 11 further characterized by continuously circulating paint from the reservoir (12), through the system supply line (34), through the atomizer feed lines (16), to the atomizers (14), through the system reservoir line (36), through the atomizer return lines (18), and back to the reservoir (12) independent of the volume of paint flow discharged through the atomizers (14).

13. The method as set forth in claim 12 further characterized by supplying a predetermined volume of paint flow to each atomizer (14) via each atomizer feed line (16) greater than the volume of paint flow discharged through each atomizer (14).

* * * * *